US008490246B2

(12) United States Patent
Waddell

(10) Patent No.: US 8,490,246 B2
(45) Date of Patent: Jul. 23, 2013

(54) ADJUSTABLE HINGE

(75) Inventor: Robert Samuel Waddell, Fairbault, MN (US)

(73) Assignee: Truth Hardware Corporation, Owatonna, MN (US)

( * ) Notice: Subject to any disclaimer, the term of this patent is extended or adjusted under 35 U.S.C. 154(b) by 441 days.

(21) Appl. No.: 12/731,795

(22) Filed: Mar. 25, 2010

(65) Prior Publication Data

US 2010/0313483 A1 Dec. 16, 2010

Related U.S. Application Data

(60) Provisional application No. 61/163,766, filed on Mar. 26, 2009.

(51) Int. Cl.
*E05D 7/04* (2006.01)

(52) U.S. Cl.
USPC ..... 16/238; 16/245; 16/387

(58) Field of Classification Search
USPC ..... 16/235–246, 248, 382, 387, DIG. 39, 16/380; 49/399
See application file for complete search history.

(56) References Cited

U.S. PATENT DOCUMENTS

| | | | | |
|---|---|---|---|---|
| 442,547 | A | 12/1890 | Radler | |
| 1,103,607 | A | 7/1914 | Moore | |
| 2,373,955 | A | 4/1945 | Fuller | |
| 2,588,258 | A | 3/1952 | Lowman | |
| 4,542,558 | A * | 9/1985 | Brockhaus | 16/263 |
| 5,144,721 | A | 9/1992 | Schade | |
| 5,339,493 | A | 8/1994 | MacIntyre | |
| 5,694,665 | A * | 12/1997 | Strickland et al. | 16/238 |
| 5,701,636 | A | 12/1997 | Jahnke | |
| 5,713,105 | A * | 2/1998 | Toomey | 16/245 |
| 5,755,011 | A | 5/1998 | Green et al. | |
| 6,212,734 | B1 | 4/2001 | Commons | |
| 6,216,316 | B1 | 4/2001 | Errichiello | |
| 6,484,363 | B1 | 11/2002 | Chung | |
| 6,715,181 | B1 | 4/2004 | Fries | |
| 6,757,938 | B1 * | 7/2004 | di Vinadio | 16/242 |
| 7,162,774 | B1 | 1/2007 | Von Resch et al. | |
| 7,240,400 | B2 | 7/2007 | Bonham | |
| 7,293,329 | B2 | 11/2007 | Heid | |
| 7,331,085 | B2 | 2/2008 | Heid | |
| 7,334,293 | B2 | 2/2008 | Erickson et al. | |
| 7,346,959 | B2 | 3/2008 | Heid | |
| 7,552,511 | B2 * | 6/2009 | Campbell et al. | 16/238 |
| 7,571,516 | B2 | 8/2009 | Lueffe et al. | |
| 7,587,788 | B2 | 9/2009 | Heid | |
| 7,603,746 | B1 * | 10/2009 | von Resch et al. | 16/245 |
| 2008/0104799 | A1 * | 5/2008 | Hoppe et al. | 16/238 |

* cited by examiner

*Primary Examiner* — William L. Miller

(74) *Attorney, Agent, or Firm* — Patterson Thente Pedersen, P.A.

(57) ABSTRACT

An adjustable hinge easily operable to adjust the position of a swinging door vertically and/or horizontally within a door frame.

14 Claims, 13 Drawing Sheets

ADJUSTABLE HINGE

RELATED APPLICATIONS

This application claims the benefit of U.S. Provisional Application No. 61/163,766 entitled ADJUSTABLE HINGE, filed Mar. 26, 2009, hereby fully incorporated herein by reference.

FIELD OF THE INVENTION

The present invention relates generally to hinges, and more particularly to adjustable hinges for swinging doors.

BACKGROUND OF THE INVENTION

Swinging door assemblies are well known in the art. It is often desirable to adjust the position of the swinging door leaf in the frame to achieve optimal door operation and engagement in the frame. Adjustment of door leaf position relative to the frame is typically accomplished with one or more adjustable hinges. A drawback of existing adjustable hinge designs, however, is that they typically require at least two persons to adjust—one to hold the door in the desired position and another to adjust the hinge.

What is needed in the industry is an adjustable hinge that is easily operable to adjust a swinging door within a frame by one person without assistance.

SUMMARY OF THE INVENTION

Embodiments of the present invention meet the need of the industry for an adjustable hinge easily operable to adjust the position of a swinging door vertically and/or horizontally within a door frame.

An adjustable hinge according to an embodiment includes a first hinge member assembly (door leaf) and a second hinge member (jamb leaf), connected with a pivotal coupling enabling pivotal movement of the first hinge member relative to the second hinge member about a rotational axis extending in a vertical direction. The first hinge member assembly (door leaf) may have a plate formed with at least one knuckle registered with the knuckles of the second hinge member and coupled with the second hinge member, and a housing adapted to be secured to the other of the elements and formed with a slot receiving the plate. The slot forms a fulcrum for pivoting of the plate relative to the housing about an adjustment axis parallel to but offset from the pivotal coupling axis through angularly offset positions. An adjustable element is provided for fixing the plate in the slot in any of the angularly offset positions. The horizontal position of the knuckle can be adjusted before or after the hinge is installed between the door and the frame element. This makes it possible to finely adjust the door position easily, shifting the door toward or away from the latch side of the frame, with only one person.

According to an embodiment of the invention the slot is open toward the vertical coupling axis, has a mouth at the adjustment axis with a width equal substantially to the thickness of the plate, and is of greater width on a side of the mouth remote from the vertical coupling axis so that the mouth forms a fulcrum defining the adjustment axis. The plate is provided with pins offset from and spaced apart relative to the adjustment axis projecting transversely toward the top and bottom of the housing.

The adjustment element according to embodiments of the invention may be a transverse adjustment screw engaged between the plate and the housing and offset from the adjustment axis for pivoting the plate about the adjustment axis on rotation of the screw. The plate is formed with a threaded hole in which the adjustment screw is engaged. The screw is trapped between a top plate and the base of the housing. The screw has one end formed with a tool recess, with the top plate having a through hole giving access to the tool recess so that a tool can be inserted through the hole to rotate the screw and pivot the plate. The hole is elongated parallel to the adjustment access.

The second hinge member (jamb leaf) may be a plate formed with at least two knuckles registered with the knuckle of the first hinge member assembly. The lower knuckle is threaded to receive an adjustment screw that may move along the vertical coupling axis. This allows selective movement of the first hinge member assembly relative to the second hinge member in the vertical direction. This additional axial adjustability can be provided in addition to or instead of the horizontal adjustability. This axial adjustability enables adjustment of the door up or down within the door frame.

With axial adjustability it is possible to compensate for imperfect positioning of the hinges. A door assembly according to embodiments of the invention may have at least one hinge with horizontal adjustability and one with axial adjustability. In a three-hinge system the center hinge has both degrees of adjustability or just axial adjustability, and the end hinges can have only horizontal adjustability. Alternatively, the horizontal and axial adjustments can be combined in a single hinge assembly.

Accordingly, in an embodiment, a hinge for coupling a door to a door frame includes a jamb leaf adapted to attach to the door frame, the jamb leaf defining a pair of spaced apart knuckles, a door interface assembly adapted to attach to the door, the door interface assembly including a door leaf base defining a recess, and a door leaf plate, the door leaf plate defining a knuckle, wherein a portion of the door leaf plate is received in the recess of the door leaf base, and a pin assembly including a hinge pin extending through the spaced apart knuckles of the jamb leaf and the knuckle of the door leaf plate to operably couple the jamb leaf and the door interface assembly. The hinge may further include a horizontal adjustment element arranged to enable selective shifting of the door leaf plate within the recess of the door leaf base so as to adjust the horizontal position of the door relative to the door frame. The horizontal adjustment element may be a screw threaded into the door leaf plate.

In further embodiments, the hinge may further include a vertical adjustment element arranged to enable selective shifting of the door leaf plate relative to the jamb leaf plate so as to adjust the vertical position of the door relative to the door frame. The vertical adjustment element may include a vertical adjustment screw threaded into a lower one of the pair of spaced apart knuckles of the jamb leaf. The pin assembly may further include at least one thrust bearing.

In another embodiment, a hinge for coupling a door to a door frame includes a jamb leaf adapted to attach to the door frame, the jamb leaf defining a pair of spaced apart knuckles. A door interface assembly is adapted to attach to the door, the door interface assembly including a door leaf base defining a recess and an aperture extending from an inner edge of the door leaf base to the recess, and a door leaf plate, the door leaf plate defining a knuckle, wherein a portion of the door leaf plate is received through the aperture into the recess of the door leaf base, the door leaf plate operably coupled to the door leaf base with at least one pin. A pin assembly including a hinge pin extends through the spaced apart knuckles of the jamb leaf and the knuckle of the door leaf plate to operably couple the jamb leaf and the door interface assembly.

In embodiments of the invention, the pin assembly of the hinge further includes a vertical adjustment element arranged to enable selective shifting of the door leaf plate relative to the jamb leaf plate so as to adjust the vertical position of the door relative to the door frame. The vertical adjustment element may include a vertical adjustment screw threaded into a lower one of the pair of spaced apart knuckles of the jamb leaf. The pin assembly may further include at least one thrust bearing.

In other embodiments, the door interface assembly further includes a horizontal adjustment element arranged to enable selective shifting of the door leaf plate within the recess of the door leaf base so as to adjust the horizontal position of the door relative to the door frame. The horizontal adjustment element may be a screw threaded into the door leaf plate.

In still further embodiments, a door assembly includes a door, a door frame defining an opening for receiving the door therein, and a hinge for operably coupling the door to the door frame. The hinge can include a jamb leaf attached to the door frame, the jamb leaf defining a pair of spaced apart knuckles, a door interface assembly attached to the door, the door interface assembly including a door leaf base defining a recess, and a door leaf plate, the door leaf plate defining a knuckle, wherein a portion of the door leaf plate is received in the recess of the door leaf base, and a pin assembly including a hinge pin extending through the spaced apart knuckles of the jamb leaf and the knuckle of the door leaf plate to operably couple the jamb leaf and the door interface assembly.

The door assembly may include a horizontal adjustment element arranged to enable selective shifting of the door leaf plate within the recess of the door leaf base so as to adjust the horizontal position of the door relative to the door frame. The horizontal adjustment element may be a screw threaded into the door leaf plate. In other embodiments, the door assembly may include a pin assembly with a vertical adjustment element arranged to enable selective shifting of the door leaf plate relative to the jamb leaf plate so as to adjust the vertical position of the door relative to the door frame. The vertical adjustment element can include a vertical adjustment screw threaded into a lower one of the pair of spaced apart knuckles of the jamb leaf.

The above summary of the various representative embodiments of the invention is not intended to describe each illustrated embodiment or every implementation of the invention. Rather, the embodiments are chosen and described so that others skilled in the art may appreciate and understand the principles and practices of the invention. The figures in the detailed description that follows more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
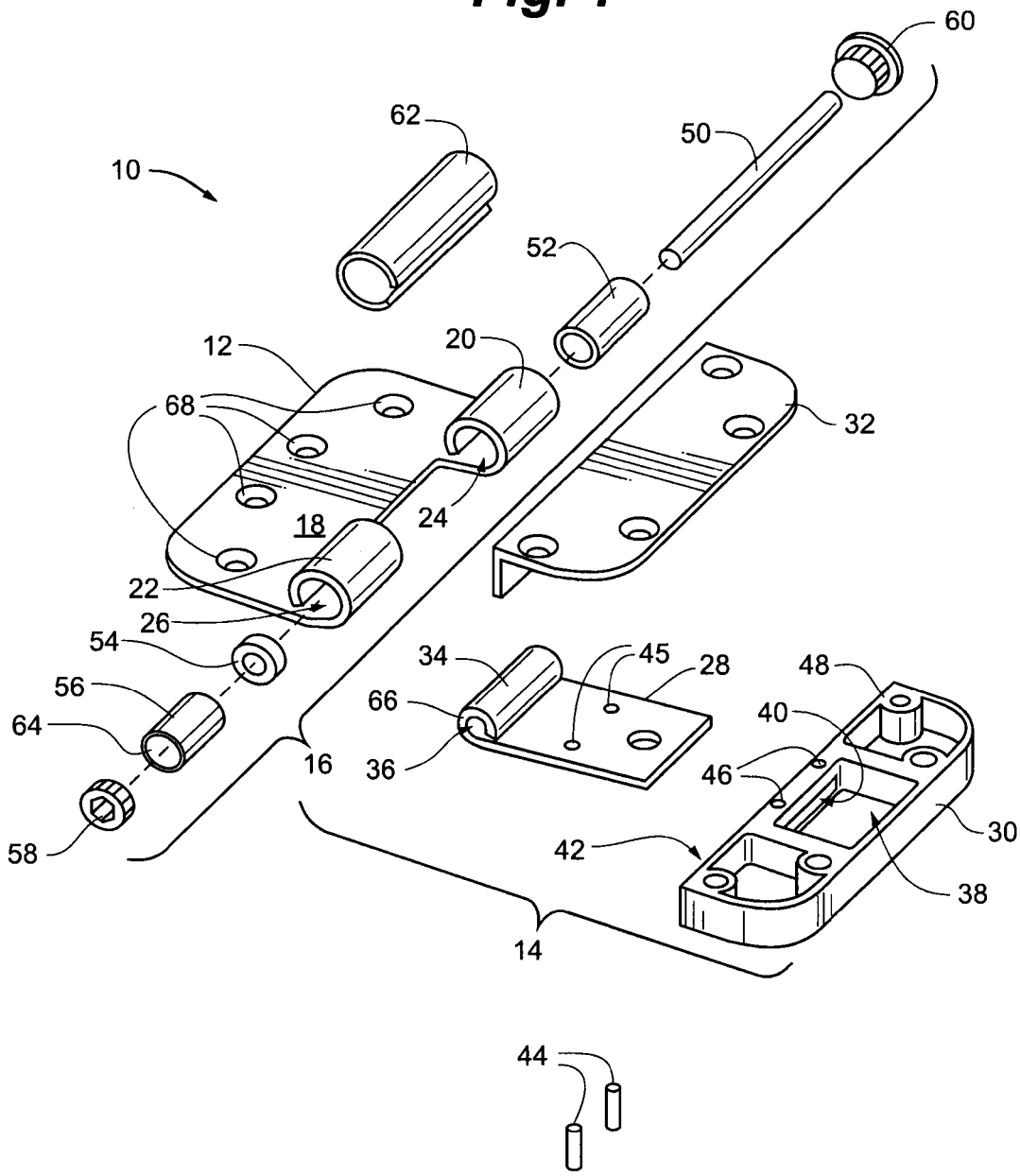
FIG. 1 is an exploded perspective view of a vertically adjustable hinge according to an embodiment of the invention.
Figure 1A:
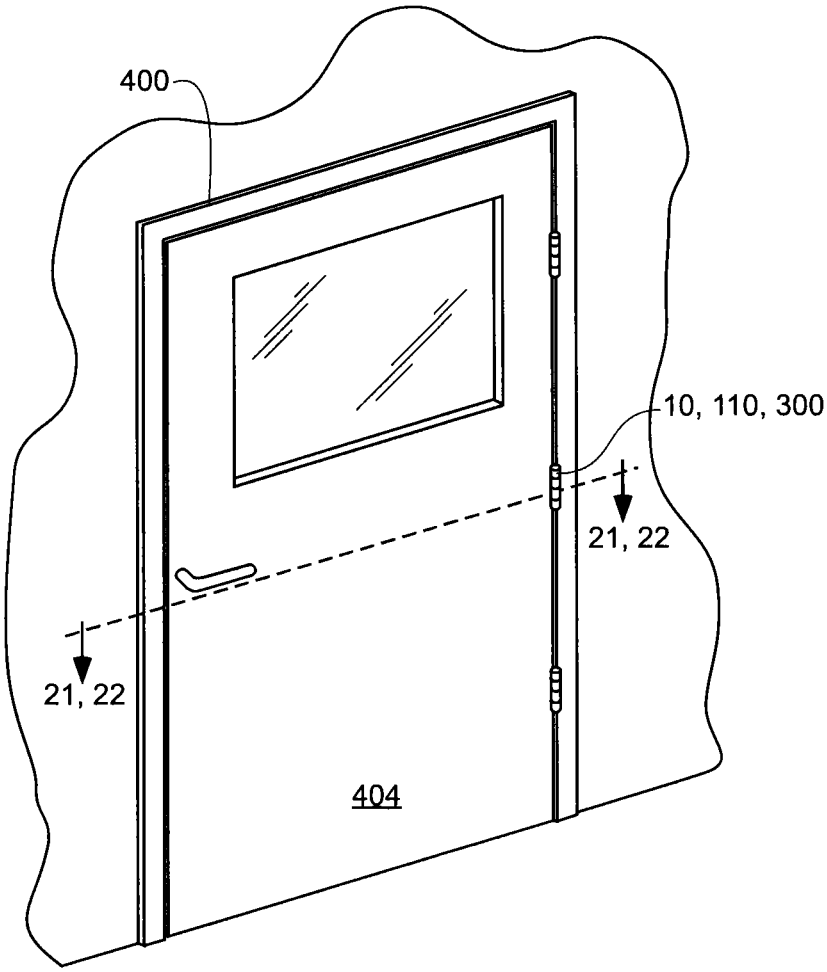
FIG. 1A is a perspective view of a door assembly according to embodiments of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE PREFERRED EMBODIMENTS

A vertically adjustable hinge according to a first embodiment of the invention is depicted in FIG. 1. Hinge assembly 10 generally includes jamb interface leaf 12, a door interface assembly in the form of door interface leaf 14, and pin assembly 16. Jamb interface leaf 12 generally includes interface plate portion 18 and spaced apart knuckle portions 20, 22, each of which defines a bore 24, 26, respectively.

Door interface leaf 14 generally includes door leaf plate 28, door leaf base 30 and cover plate 32. Door leaf plate 28 includes knuckle portion 34 defining bore 36. Door leaf base 30 defines recess 38 with aperture 40 extending through from recess 38 to inner side 42. Door leaf plate 28 is received through aperture 40 and is pinned in place with pins 44 extending through apertures 45 and pin apertures 46. Cover plate 32 is received on, and covers, open side 48 of door leaf base 30.

Pin assembly 16 generally includes hinge pin 50, open sleeve bushing 52, thrust bearing 54, closed sleeve bushing 56, vertical adjustment screw 58, hinge pin plug 60, and barrel cover 62. Open sleeve bushing 52 is received in bore 24 of knuckle portion 20 and closed sleeve bushing 56 is received in bore 26 of knuckle portion 22. Vertical adjustment screw 58 is threaded into the bottom end of knuckle portion 22 and bears against bottom face 64 of closed sleeve bushing 56. Hinge pin 50 extends through open sleeve bushing 52, bore 36 of knuckle portion 34, thrust bearing 54, and into closed sleeve bushing 56. Bottom edge 66 of knuckle portion 34 bears on thrust bearing 54, which in turn bears on closed sleeve bushing 56. Hinge pin plug 60 threads into the top end of bore 24 of knuckle portion 20. Barrel cover 62 fits over knuckle portion 34 between knuckle portions 20, 22, to give a finished look to hinge 10.

Figure 3A:
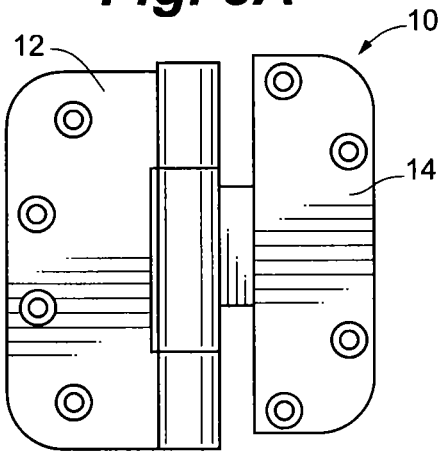
FIG. 3A is an elevation view of the vertically adjustable hinge of FIG. 1 or 2 depicting the hinge positioned at an uppermost limit of adjustment.

In use, jamb interface leaf 12 is secured to a door frame 400 with fasteners 402 through apertures 68. Door interface leaf 14 is secured to a door 404 with door leaf base 30 received in a recess in the door. The door is adjusted vertically within the frame by threading vertical adjustment screw 58 into and out of knuckle portion 22. In FIG. 3A, vertical adjustment screw 58 is threaded into knuckle portion 22 to its full upward limit of travel, thereby shifting closed sleeve bushing 56, thrust bearing 54, and door leaf plate 28 upward relative to jamb interface leaf 12. Since door leaf plate 28 is vertically fixed to door leaf base 30, the door is also shifted upward in the frame.

Figure 3B:
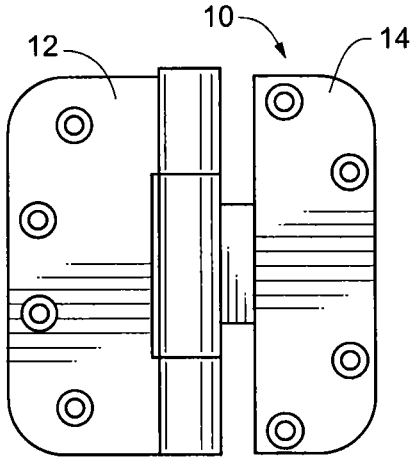
FIG. 3B is an elevation view of the vertically adjustable hinge of FIG. 1 or 2 depicting the hinge positioned at a point intermediate in the range of adjustment.
Figure 3C:
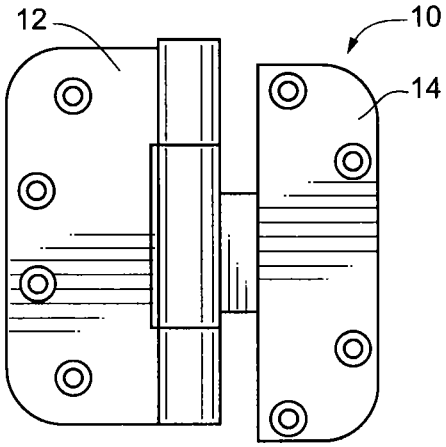
FIG. 3C is an elevation view of the vertically adjustable hinge of FIG. 1 or 2 depicting the hinge positioned at a lowermost limit of adjustment.

As depicted in FIG. 3B, closed sleeve bushing 56, thrust bearing 54, and door leaf plate 28 shift downward relative to jamb interface leaf 12 as vertical adjustment screw 58 is threaded out of knuckle portion 22, thereby also shifting the door vertically downward in the frame. The door may be adjusted downward in the frame still further until vertical adjustment screw 58 reaches its lower limit as depicted in FIG. 3C. Upward adjustment of the door in the frame is accomplished by the reverse procedure.

Figure 2:
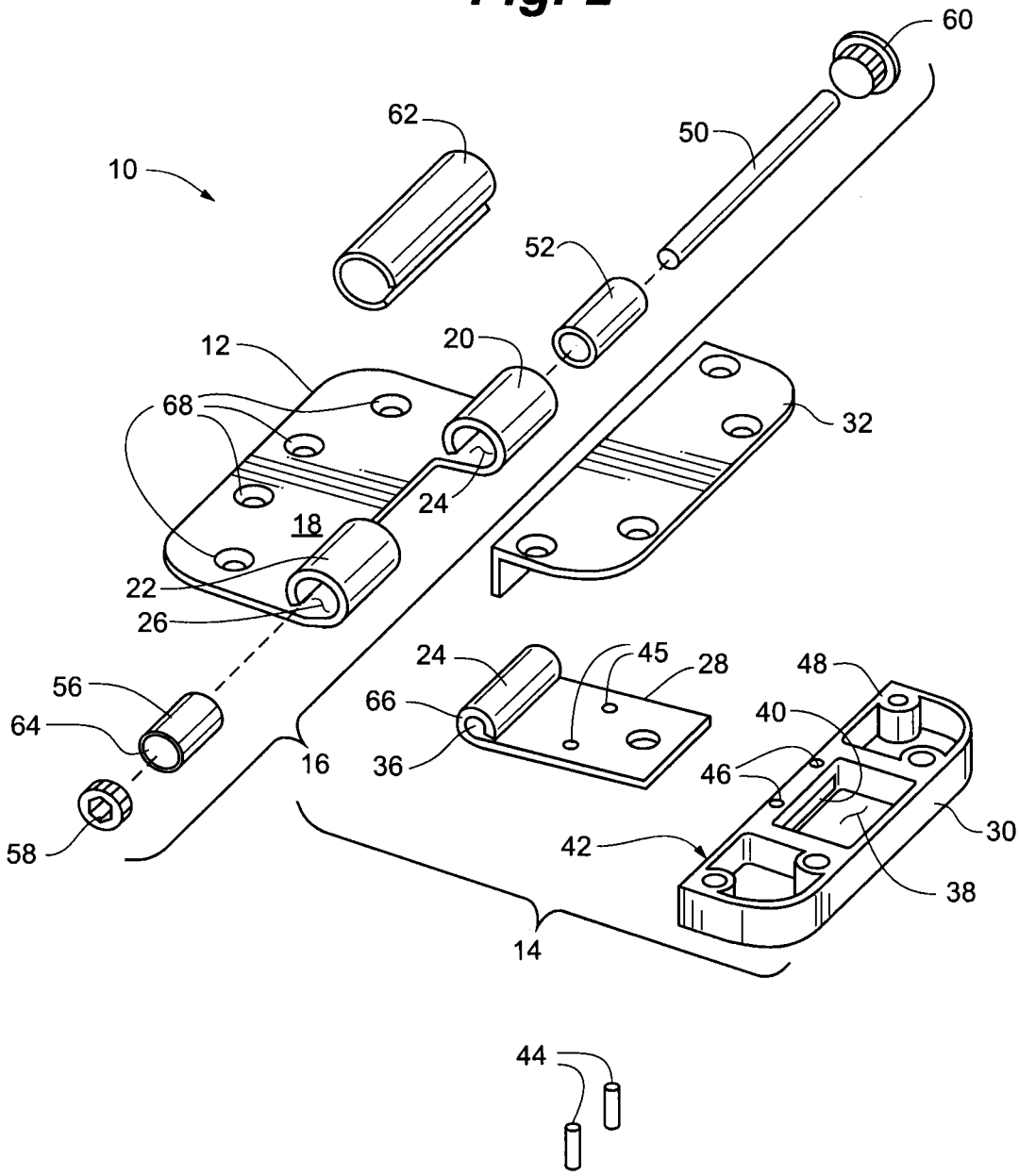
FIG. 2 is an exploded perspective view of a vertically adjustable hinge according to an alternative embodiment of the invention.

In the embodiment of FIG. 2, thrust bearing 54 is omitted. Otherwise, the FIG. 2 embodiment has the identical structure and function as that of the FIG. 1 embodiment.

Figure 4:
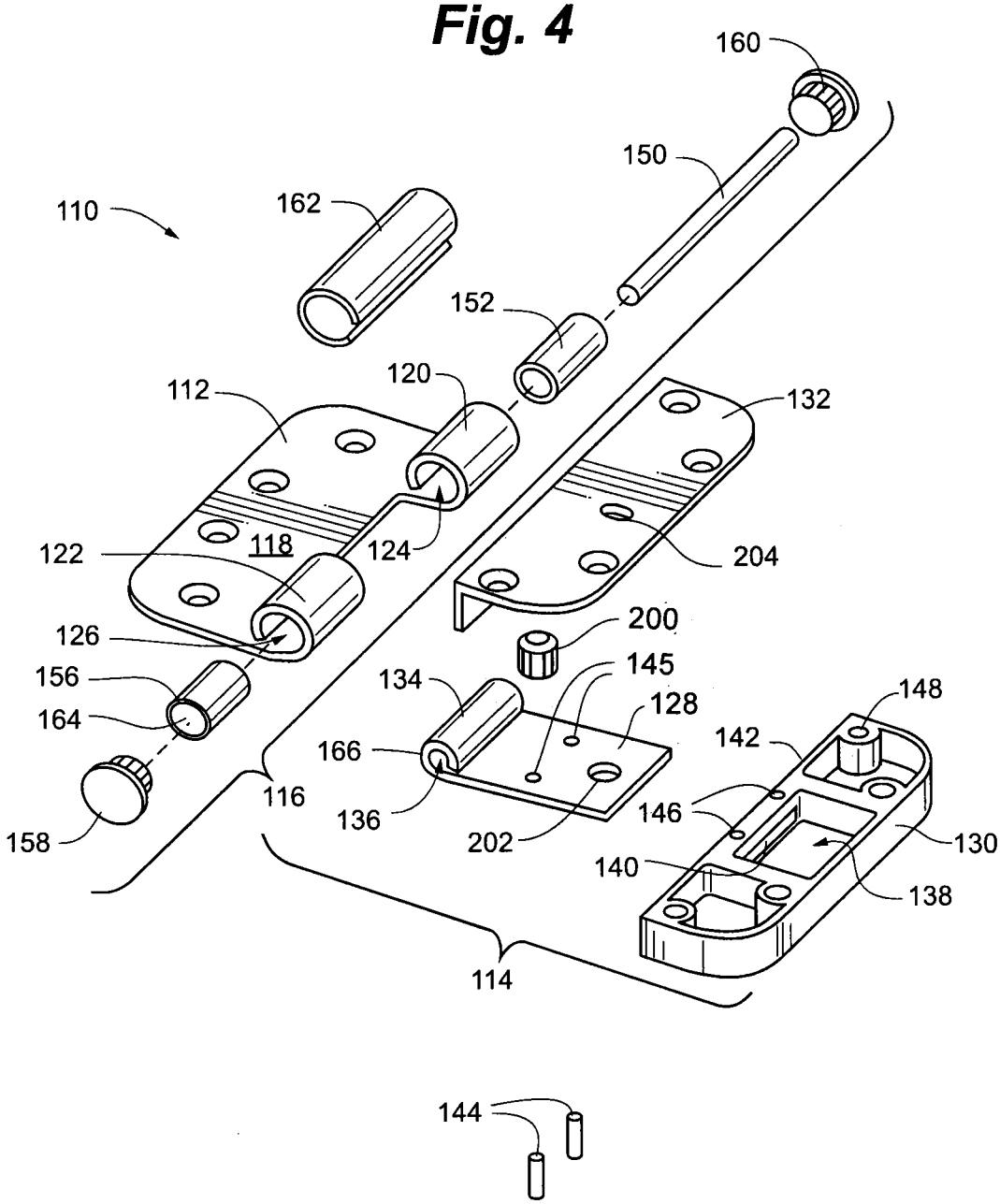
FIG. 4 is an exploded perspective view of a horizontally adjustable hinge according to an embodiment of the invention.

A horizontally adjustable hinge according to another embodiment of the invention is depicted in FIG. 4. Hinge assembly 110 generally includes jamb interface leaf 112, a door interface assembly in the form of door interface leaf 114, and pin assembly 116. Jamb interface leaf 112 generally includes interface plate portion 118 and spaced apart knuckle portions 120, 122, each of which defines a bore 124, 126, respectively.

Door interface leaf 114 generally includes door leaf plate 128, door leaf base 130 and cover plate 132. Door leaf plate 128 includes knuckle portion 134 defining bore 136. Door leaf base 130 defines recess 138 with aperture 140 extending through from recess 138 to inner side 142. Door leaf plate 128 is received through aperture 140 and is pinned in place with pins 144 extending through apertures 145 and pin apertures 146. Cover plate 132 is received on, and covers, open side 148 of door leaf base 130. Adjustment screw 200 is threaded into aperture 202 and is accessible through aperture 204 in cover plate 132.

Pin assembly 116 generally includes hinge pin 150, open sleeve bushing 152, closed sleeve bushing 156, bottom pin plug 158, top pin plug 160, and barrel cover 162. Open sleeve bushing 152 is received in bore 124 of knuckle portion 120 and closed sleeve bushing 156 is received in bore 126 of knuckle portion 122. Bottom pin plug 158 is threaded into the bottom end of knuckle portion 122 and bears against bottom face 164 of closed sleeve bushing 156. Hinge pin 150 extends through open sleeve bushing 152, bore 136 of knuckle portion 134, and into closed sleeve bushing 156. Bottom edge 166 of knuckle portion 134 bears on closed sleeve bushing 156. Top pin plug 160 threads into the top end of bore 124 of knuckle portion 120. Barrel cover 162 fits over knuckle portion 134 between knuckle portions 120, 122, to give a finished look to hinge 110.

Figure 5A:
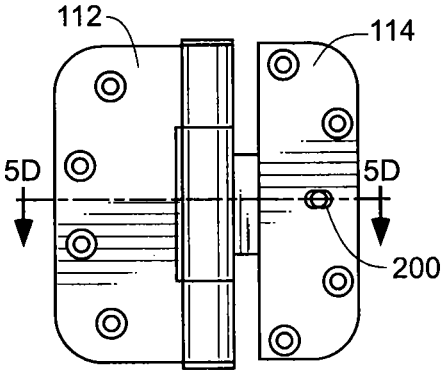
FIG. 5A is an elevation view of the horizontally adjustable hinge of FIG. 4 depicting the hinge positioned at a maximum limit of adjustment.
Figure 21:
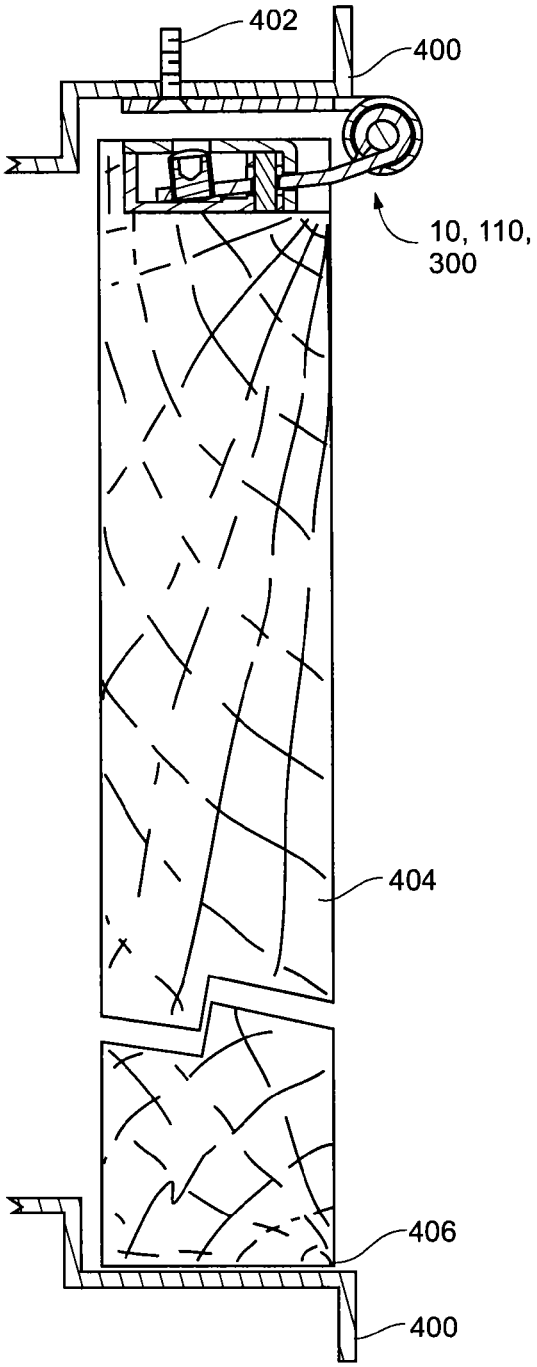
FIG. 21 is a cross-sectional view of the door assembly of FIG. 1A taken at section 21-21 and depicting the door and hinge adjusted to a position furthest from the hinge side of the frame.

In use, jamb interface leaf 112 is secured to a door frame 400 with fasteners 402 through apertures 168. Door interface leaf 114 is secured to a door 404 with door leaf base 130 received in a recess in the door. The door is adjusted horizontally relative to the frame by threading adjustment screw 200 into and out of aperture 202 in door leaf plate 128, thereby changing the orientation of door leaf plate 128 within door leaf base 130. In FIGS. 5C and 5F, adjustment screw 200 is threaded out of aperture 202 to its full limit of travel, thereby shifting door leaf plate 128 at an angle within door leaf base 130 such that the planar back of door leaf base 130 is disposed well forward of planar back 208 of jamb interface leaf 112 when the hinge 110 is positioned as depicted in the section view of FIG. 5F. When the hinge is operated in the direction of the arrow to close the door, door leaf base 130 will be relatively further from jamb interface leaf 112, thereby shifting the door within the frame toward latch side 406 as depicted in FIG. 21.

Figure 5B:
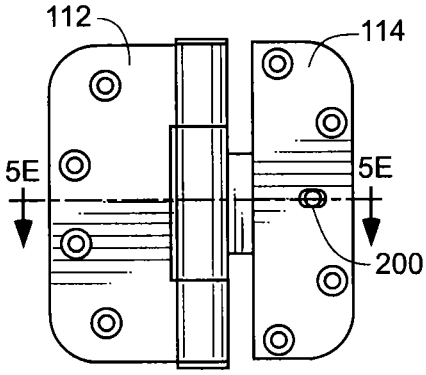
FIG. 5B is an elevation view of the horizontally adjustable hinge of FIG. 4 depicting the hinge positioned at an intermediate adjustment point.
Figure 5C:
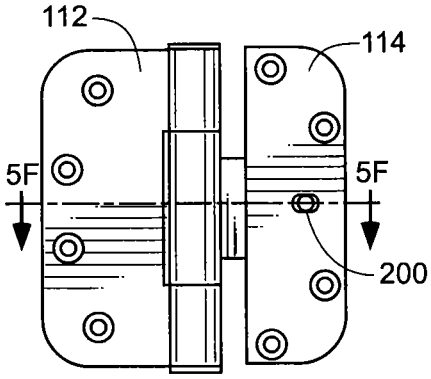
FIG. 5C is an elevation view of the horizontally adjustable hinge of FIG. 4 depicting the hinge positioned at a minimum limit of adjustment.
Figure 5D:
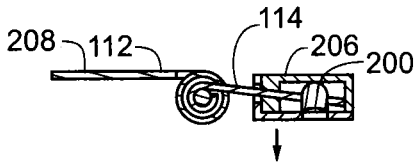
FIG. 5D is a cross-section view taken at section 5D-5D of FIG. 5A.
Figure 5E:
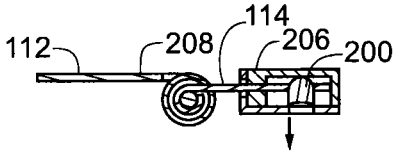
FIG. 5E is a cross-section view taken at section 5E-5E of FIG. 5B.
Figure 5F:
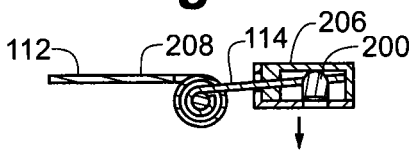
FIG. 5F is a cross-section view taken at section 5F-5F of FIG. 5C.

As depicted in FIGS. 5B and 5E, door leaf plate 128 shifts within door leaf base 130 as adjustment screw 200 is threaded into aperture 202. Planar back of door leaf base 130 is shifted rearwardly relative to planar back 208 of jamb interface leaf 112 when the hinge 110 is positioned as depicted in the section view of FIG. 5E. When the hinge is operated in the direction of the arrow to close the door, door leaf base 130 will be relatively closer to jamb interface leaf 112.

Figure 22:
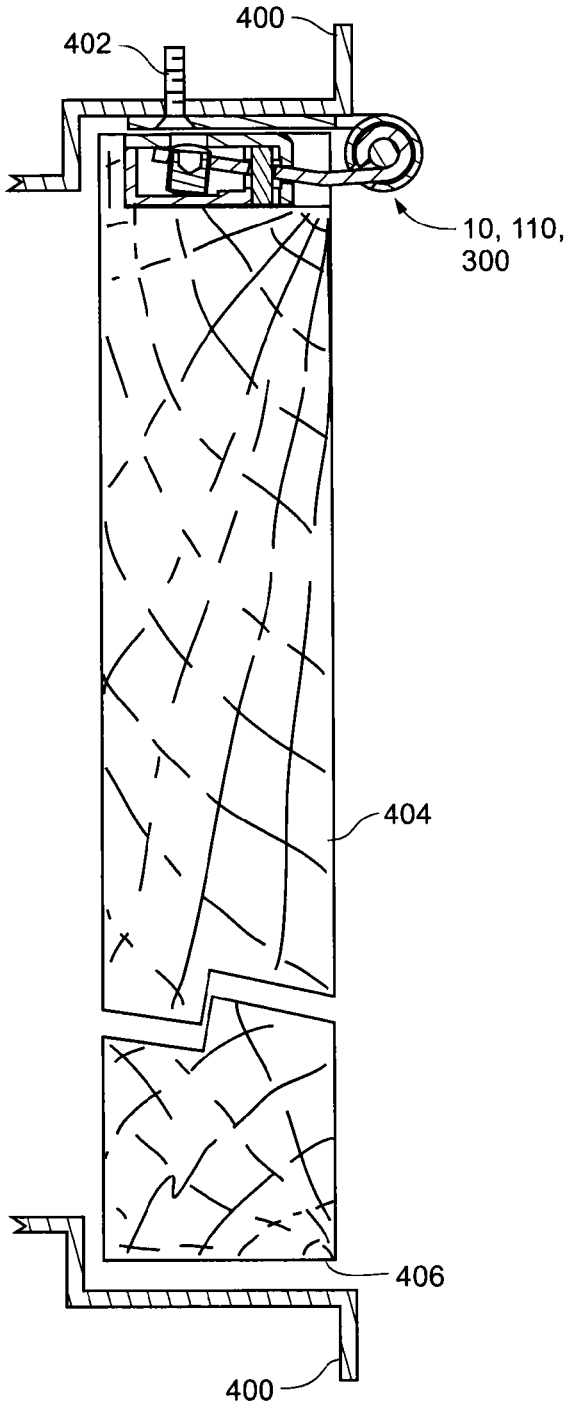
FIG. 22 is a cross-sectional view of the door assembly of FIG. 1A taken at section 22-22 and depicting the door and hinge adjusted to a position closest to the hinge side of the frame.

Adjustment screw 200 may be adjusted still further until adjustment screw 200 reaches its limit as depicted in FIGS. 5A and 5D. In this position, the door is positioned at its greatest limit of travel toward the jamb receiving jamb interface leaf 112 so that door 404 is shifted within the frame 400 away from latch side 406 as depicted in FIG. 22. Adjustment of the door in the opposite direction is accomplished by the reverse procedure.

It will be appreciated by those of ordinary skill in the art that either of the vertically adjustable embodiments of FIG. 1 or 2 could be combined with the horizontally adjustable embodiment of FIG. 4 so that the resulting hinge is both vertically and horizontally adjustable. For instance, a horizontally and vertically adjustable hinge according to another embodiment of the invention is depicted in FIGS. 6-20. FIGS. 7-13 depict a lighter duty hinge, while FIGS. 14-20 depict a heavier duty version of the hinge. Hinge assembly 300 generally includes jamb interface leaf 302, a door interface assembly in the form of door interface leaf 304, and pin assembly 306. Jamb interface leaf 302 generally includes interface plate portion 308 and spaced apart knuckle portions 310, 312, each of which defines a bore 314, 316, respectively.

Door interface leaf 304 generally includes door leaf plate 318, door leaf base 320 and cover plate 322. Door leaf plate 318 includes knuckle portion 324 defining bore 326. Door leaf base 320 defines recess 328 with aperture 330 extending through from recess 328 to inner side 332. Door leaf plate 318 is received through aperture 330 and is pinned in place with pins 334 extending through apertures 336 and pin apertures 338. Cover plate 322 is received on, and covers, open side 340 of door leaf base 320. Adjustment screw 342 is threaded into aperture 344 and is accessible through aperture 346 in cover plate 322.

Pin assembly 306 generally includes hinge pin 348, sleeve bushing 350, thrust bearings 352, 354, bushing 356, vertical adjustment screw 358, hinge pin plug 360, and barrel cover 362. Barrel portion 364 of sleeve bushing 350 is received in bore 316 of knuckle portion 312 with head portion 366 abutting bottom surface 368 and bushing 356 is received in bore 314 of knuckle portion 310. Vertical adjustment screw 358 is threaded into the bottom end of knuckle portion 310 and bears against bottom face 370 of bushing 356 and bottom face 372 of hinge pin 348. Hinge pin 348 extends through sleeve bushing 350, bore 326 of knuckle portion 324, thrust bearings 352, 354, and bushing 356 and is retained with e-clip 376 received in groove 378. In the heavier-duty embodiment of FIGS. 14-20 thrust bearings 352, 354, are replaced with a single ball-bearing thrust bearing 355. Bottom face 374 of knuckle portion 324 bears on thrust bearings 352, 354, which in turn bear on bushing 356. Hinge pin plug 360 plugs the top end of bore 316 of knuckle portion 312. Barrel cover 62 fits over knuckle portion 34 between knuckle portions 20, 22, to give a finished look to hinge 10.

Figure 10:
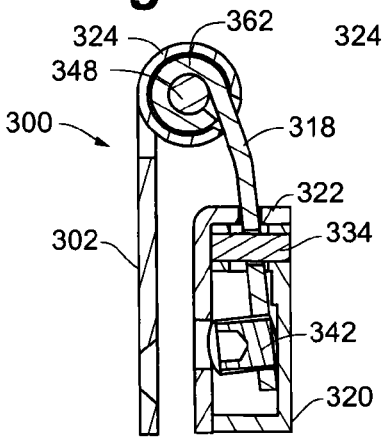
FIG. 10 is a cross-sectional view of the hinge of FIG. 7 taken at section 10-10 of FIG. 7 and depicting the horizontal adjustment of the hinge at a first limit of travel and with the hinge in a closed position.
Figure 17:
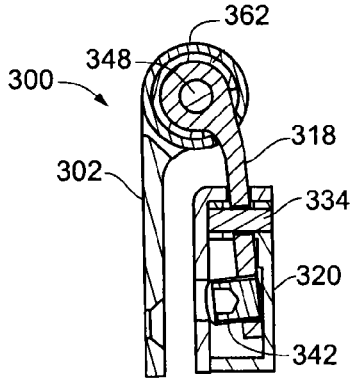
FIG. 17 is a cross-sectional view of the hinge of FIG. 14 taken at section 17-17 of FIG. 14 and depicting the horizontal adjustment of the hinge at a first limit of travel and with the hinge in a closed position.
Figure 19:
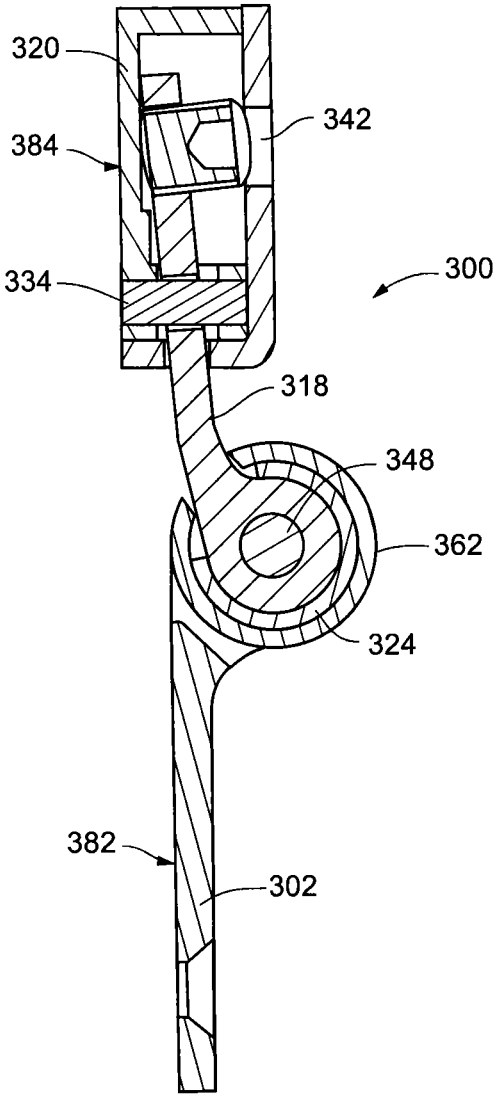
FIG. 19 is a cross-sectional view of the hinge of FIG. 14 taken at section 19-19 of FIG. 14 and depicting the horizontal adjustment of the hinge at a first limit of travel and with the hinge in an open position.
Figure 20:
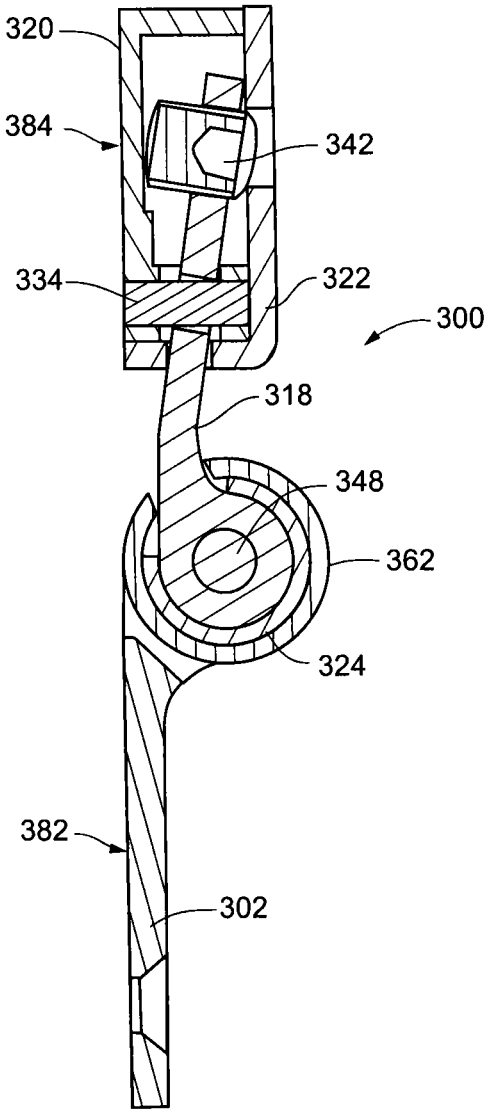
FIG. 20 is a cross-sectional view of the hinge of FIG. 14 taken at section 20-20 of FIG. 14 and depicting the horizontal adjustment of the hinge at an opposite limit of travel and with the hinge in an open position.

In use, jamb interface leaf 302 is secured to a door frame 400 with fasteners 402 through apertures 380. Door interface leaf 304 is secured to a door 404 with door leaf base 320 received in a recess in the door. The door is adjusted horizontally relative to the frame by threading adjustment screw 342 into and out of aperture 344 in door leaf plate 318, thereby changing the orientation of door leaf plate 318 within door leaf base 320 as depicted in FIGS. 10-13 and 17-20. In FIGS. 10, 12, 17, and 19, adjustment screw 342 is threaded out of aperture 344 to its full limit of travel, thereby shifting door leaf plate 318 at an angle within door leaf base 320 such that the planar back of door leaf base 320 is disposed well forward of planar back 382 of jamb interface leaf 302 when the hinge 300 is positioned as depicted in the section views of FIGS. 12 and 17. When the hinge is operated to close the door as depicted in FIGS. 10 and 17, door leaf base 320 will be relatively further away from jamb interface leaf 302, thereby shifting the door within the frame toward the latch side of the door.

Figure 11:
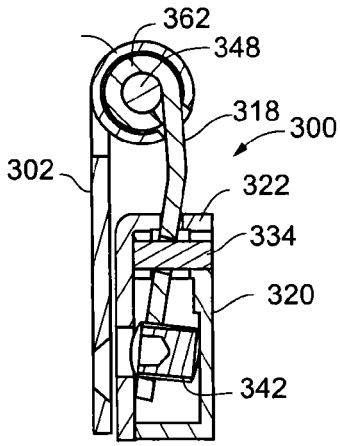
FIG. 11 is a cross-sectional view of the hinge of FIG. 7 taken at section 11-11 of FIG. 7 and depicting the horizontal adjustment of the hinge at an opposite limit of travel and with the hinge in a closed position.
Figure 12:
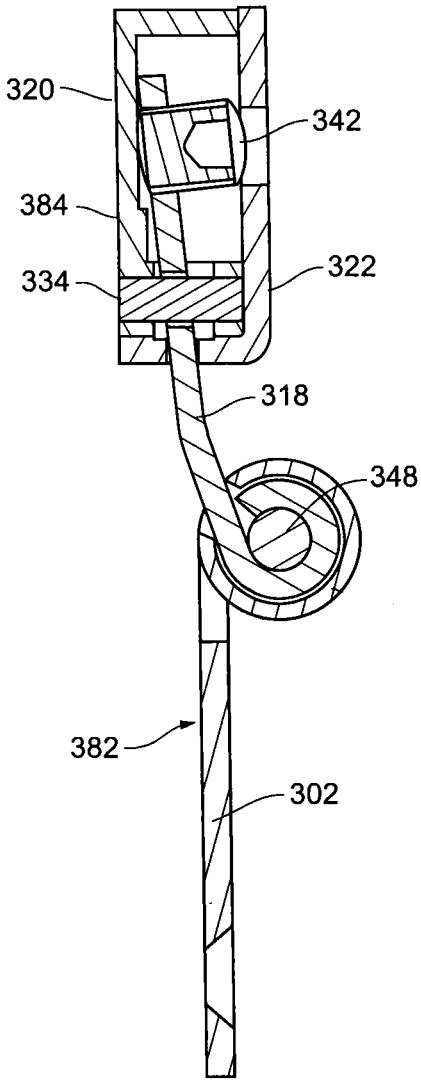
FIG. 12 is a cross-sectional view of the hinge of FIG. 7 taken at section 12-12 of FIG. 7 and depicting the horizontal adjustment of the hinge at a first limit of travel and with the hinge in an open position.
Figure 13:
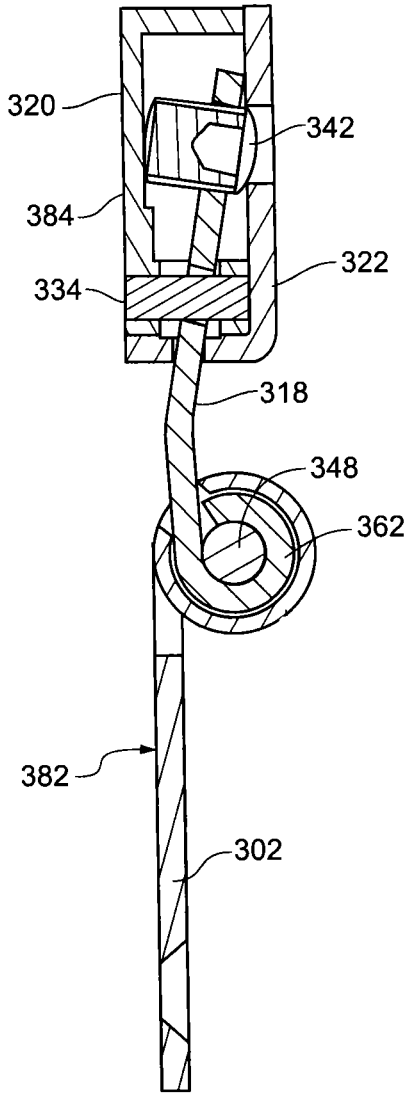
FIG. 13 is a cross-sectional view of the hinge of FIG. 7 taken at section 13-13 of FIG. 7 and depicting the horizontal adjustment of the hinge at an opposite limit of travel and with the hinge in an open position.
Figure 14:
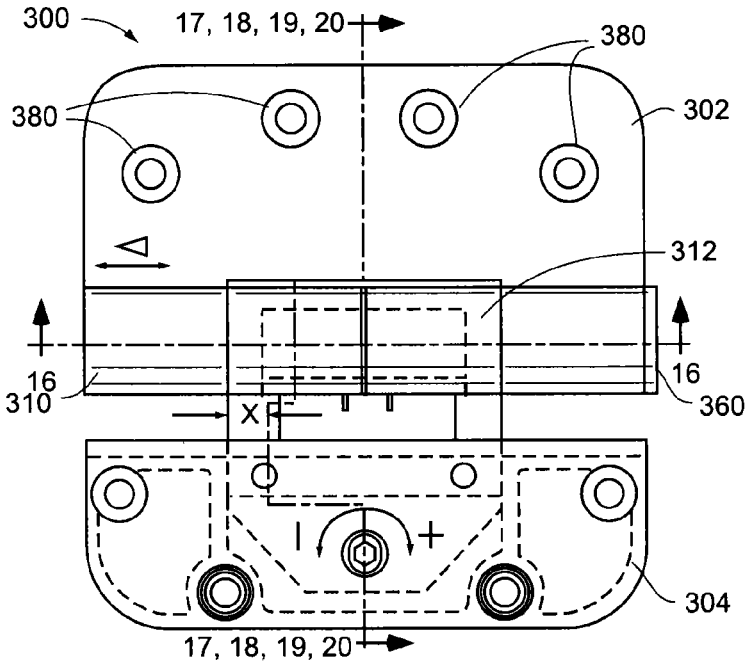
FIG. 14 is an elevation view of a heavier-duty embodiment of the hinge of FIG. 6 depicting the vertical adjustment range of the hinge in phantom.
Figure 15:
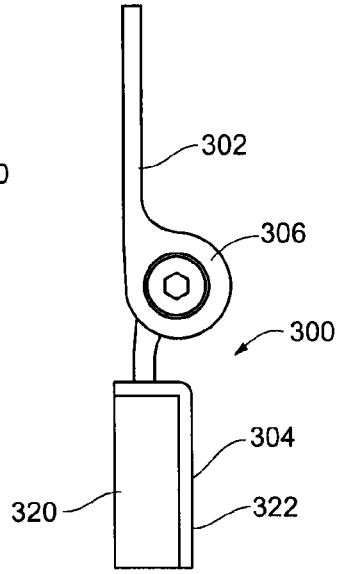
FIG. 15 is a bottom plan view of the hinge of FIG. 14.
Figure 16:
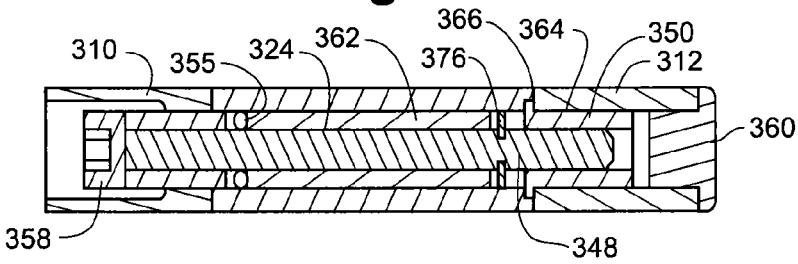
FIG. 16 is a cross-sectional view of the hinge of FIG. 14 taken at section 16-16 of FIG. 14.
Figure 18:
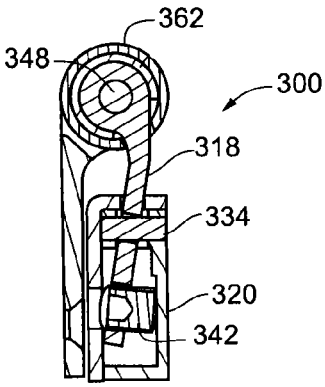
FIG. 18 is a cross-sectional view of the hinge of FIG. 14 taken at section 18-18 of FIG. 14 and depicting the horizontal adjustment of the hinge at an opposite limit of travel and with the hinge in a closed position.

As depicted in FIGS. 11, 13, 18, and 20, door leaf plate 318 shifts within door leaf base 320 as adjustment screw 342 is threaded into aperture 344. Planar back 384 of door leaf base 320 is shifted rearwardly relative to planar back 382 of jamb interface leaf 302 when the hinge 300 is positioned as depicted in the section views of FIGS. 13 and 20. When the hinge is operated to close the door as depicted in FIGS. 11 and 18, door leaf base 320 will be relatively closer to jamb interface leaf 302, thereby shifting the door within the frame away from the latch side of the door.

Vertical adjustment of the door within the frame is achieved by threading vertical adjustment screw 358 into and out of knuckle portion 310. As vertical adjustment screw is threaded further into knuckle portion 310, bushing 356 and thrust bearings 352, 354, and knuckle 322 of door leaf plate 318 are urged upward relative to jamb interface leaf 302. Hence, door leaf plate may be shifted by a vertical distance x relative to jamb interface leaf 302 as denoted in FIGS. 7 and 14. Since door leaf plate 318 is vertically fixed to door leaf base 320, the attached door is also shifted upward in the frame. Conversely, as vertical adjustment screw 358 is threaded out of knuckle portion 310, the door is shifted vertically downward in the frame.

It will be appreciated that e-clip 376 essentially renders hinge pin 348 non-removable. This is advantageous from a security standpoint in that hinge 300 cannot be easily disassembled to remove the door simply by driving hinge pin 348 out of knuckles 310, 312, 324, as with typical butt hinges known in the art.

Figure 6:
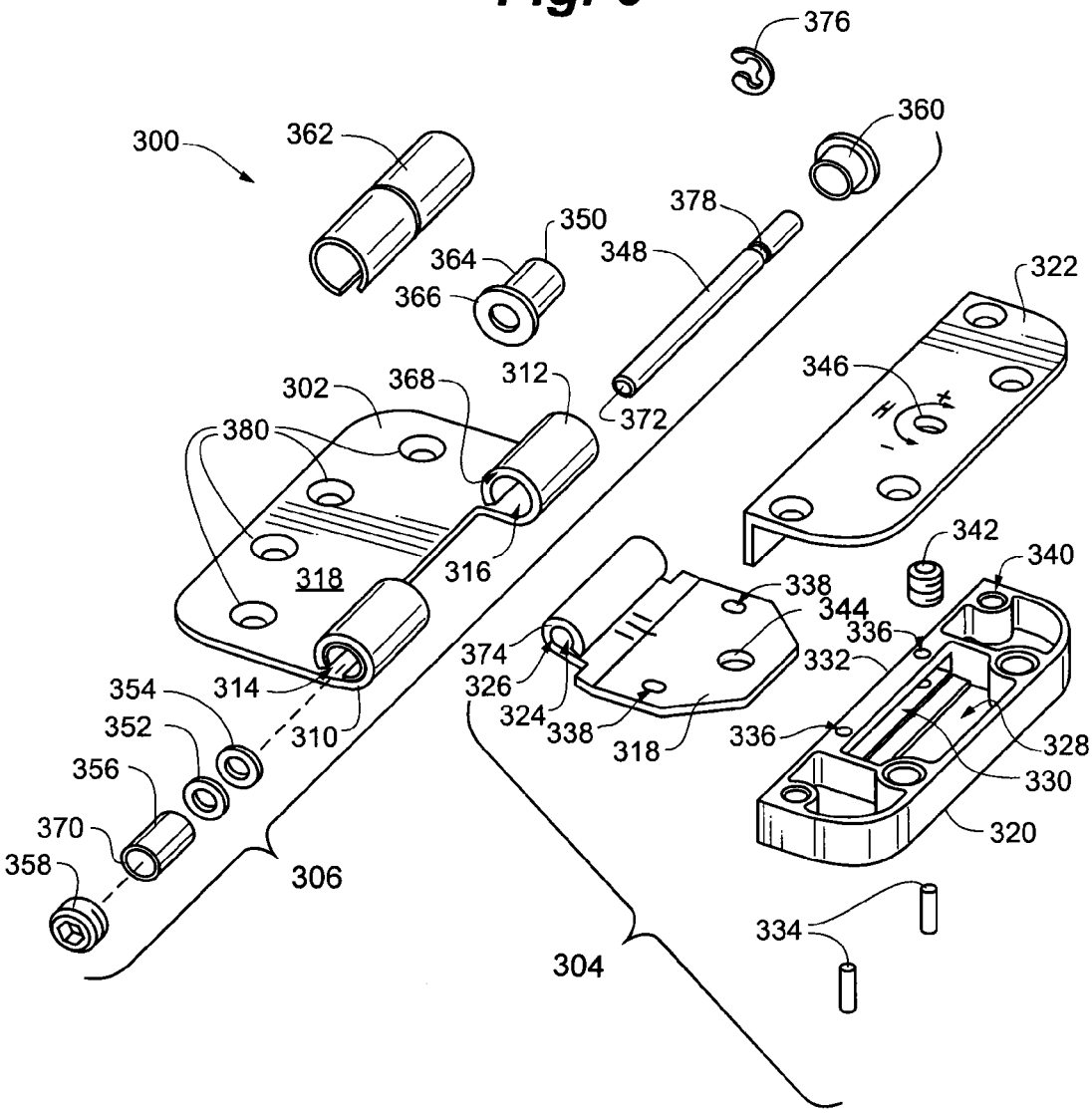
FIG. 6 is an exploded view of a horizontally and vertically adjustable hinge according to an embodiment of the invention.
Figure 7:
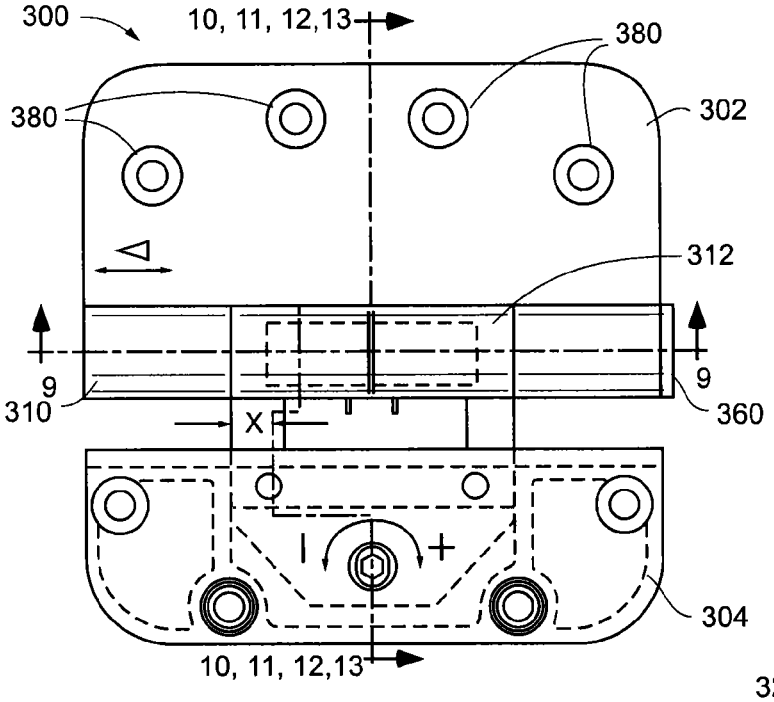
FIG. 7 is an elevation view of the hinge of FIG. 6 depicting the vertical adjustment range of the hinge in phantom.
Figure 8:
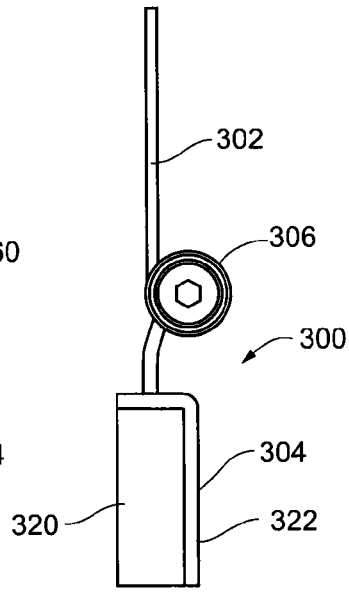
FIG. 8 is a bottom plan view of the hinge of FIG. 7.
Figure 9:
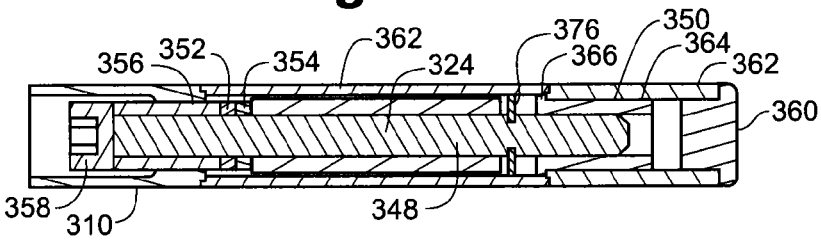
FIG. 9 is a cross-sectional view of the hinge of FIG. 7 taken at section 9-9 of FIG. 7.
Figure 23:
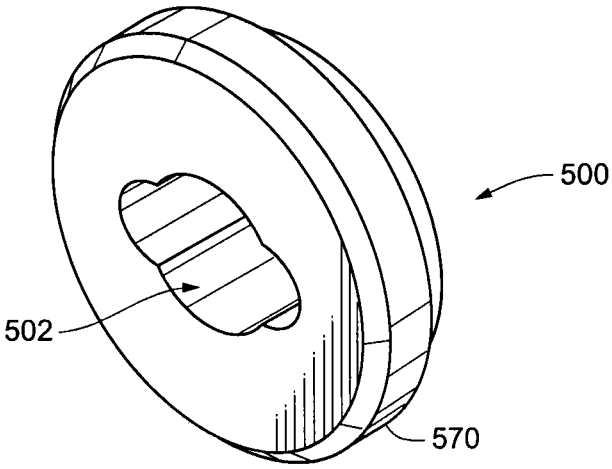
FIG. 23 is a perspective view of a lower knuckle plug according to an embodiment of the invention.
Figure 24:
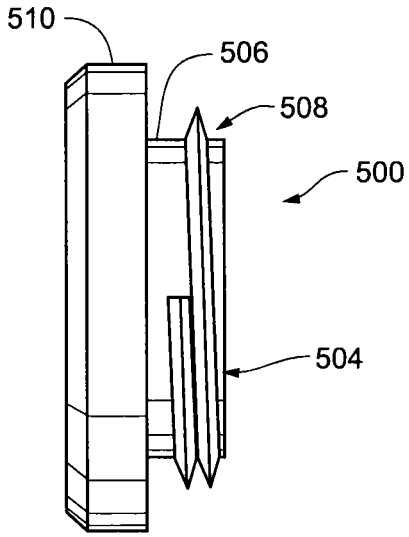
FIG. 24 is a side elevation view of the plug of FIG. 23.

It will further be appreciated that a plug 500 as depicted in FIGS. 23 and 24 can be added to the hinges of FIGS. 1, 2, and 6, to lend a more finished appearance to the hinge. Plug 500 defines aperture 502 extending through to back side 504. Barrel portion 506 defines threads 508. In use, plug 500 can be threaded into the bottom end of the bore of knuckles 22, 310, such that head 510 protrudes below the knuckles. Aperture 502 enables access to adjust the vertical adjustment screw of the hinge.

The embodiments above are intended to be illustrative and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A hinge for coupling a door to a door frame, the hinge comprising:

a jamb leaf adapted to attach to the door frame, the jamb leaf defining a pair of spaced apart knuckles;

a door interface assembly adapted to attach to the door, the door interface assembly including a door leaf base defining a recess with a cover portion disposed over the recess thereby defining an enclosure, and a door leaf plate, the door leaf plate defining a knuckle and a pin aperture, wherein a portion of the door leaf plate is received in the enclosure of the door leaf base, and wherein a pin extends from the door leaf base through the pin aperture of the door leaf plate to secure the door leaf plate in place within the enclosure;

a horizontal adjustment element arranged to enable selective shifting of the door leaf plate within the recess of the door leaf base so as to adjust the horizontal position of the door relative to the door frame, the horizontal adjustment element comprising a screw threaded into the door leaf plate, the screw having a tip bearing against the door leaf base; and a pin assembly including a hinge pin extending through the spaced apart knuckles of the jamb leaf and the knuckle of the door leaf plate to operably couple the jamb leaf and the door interface assembly.

2. The hinge of claim 1, wherein the pin assembly further comprises a vertical adjustment element arranged to enable selective shifting of the door leaf plate relative to the jamb leaf plate so as to adjust the vertical position of the door relative to the door frame.

3. The hinge of claim 2, wherein the vertical adjustment element comprises a vertical adjustment screw threaded into a lower one of the pair of spaced apart knuckles of the jamb leaf.

4. The hinge of claim 1, wherein the pin assembly further includes at least one thrust bearing.

5. The hinge of claim 1, further comprising structure for retaining the hinge pin.

6. The hinge of claim 5, wherein the structure for retaining the hinge pin comprises an e-clip engaged in a slot in the hinge pin.

7. A hinge for coupling a door to a door frame, the hinge comprising:

a jamb leaf adapted to attach to the door frame, the jamb leaf defining a pair of spaced apart knuckles;

a door interface assembly adapted to attach to the door, the door interface assembly including a door leaf base defining a recess and an aperture extending from an inner edge of the door leaf base to the recess, and a door leaf plate, the door leaf plate defining a knuckle, wherein a portion of the door leaf plate is received through the aperture into the recess of the door leaf base, the door leaf plate operably coupled to the door leaf base with at least one pin and a horizontal adjustment element arranged to enable selective shifting of the door leaf plate within the recess of the door leaf base via contact therewith so as to adjust the horizontal position of the door relative to the door frame; and a pin assembly including a hinge pin extending through the spaced apart knuckles of the jamb leaf and the knuckle of the door leaf plate to operably couple the jamb leaf and the door interface assembly.

8. The hinge of claim 7, wherein the pin assembly further comprises a vertical adjustment element arranged to enable selective shifting of the door leaf plate relative to the jamb leaf plate so as to adjust the vertical position of the door relative to the door frame.

9. The hinge of claim 8, wherein the vertical adjustment element comprises a vertical adjustment screw threaded into a lower one of the pair of spaced apart knuckles of the jamb leaf.

10. The hinge of claim 8, wherein the pin assembly further includes at least one thrust bearing.

11. The hinge of claim 7, wherein the horizontal adjustment element comprises a screw threaded into the door leaf plate.

12. A door assembly, comprising:

a door;

a door frame defining an opening for receiving the door therein; and a hinge for operably coupling the door to the door frame, the hinge comprising:

a jamb leaf attached to the door frame, the jamb leaf defining a pair of spaced apart knuckles;

a door interface assembly attached to the door, the door interface assembly including a door leaf base defining a recess with a cover portion disposed over the recess thereby defining an enclosure, and a door leaf plate, the door leaf plate defining a knuckle and a pin aperture, wherein a portion of the door leaf plate is received in the enclosure of the door leaf base, and wherein a pin extends from the door leaf base through the pin aperture of the door leaf plate to secure the door leaf plate in place within the enclosure;

a horizontal adjustment element arranged to enable selective shifting of the door leaf plate within the recess of the door leaf base so as to adjust the horizontal position of the door relative to the door frame, the horizontal adjustment element comprising a screw threaded into the door leaf plate, the screw having a tip bearing against the door leaf base; and a pin assembly including a hinge pin extending through the spaced apart knuckles of the jamb leaf and the knuckle of the door leaf plate to operably couple the jamb leaf and the door interface assembly.

13. The door assembly of claim 12, wherein the pin assembly further comprises a vertical adjustment element arranged to enable selective shifting of the door leaf plate relative to the jamb leaf plate so as to adjust the vertical position of the door relative to the door frame.

14. The door assembly of claim 13, wherein the vertical adjustment element comprises a vertical adjustment screw threaded into a lower one of the pair of spaced apart knuckles of the jamb leaf.

* * * * *